US005225737A

United States Patent [19]

Sato

[11] Patent Number: 5,225,737

[45] Date of Patent: Jul. 6, 1993

[54] DEFLECTING YOKE FOR CATHODE RAY TUBE

[75] Inventor: Hidenori Sato, Tamana, Japan

[73] Assignee: Matsushita Electric Industrial Co., Ltd., Osaka, Japan

[21] Appl. No.: 770,254

[22] Filed: Oct. 3, 1991

[30] Foreign Application Priority Data

Oct. 5, 1990 [JP] Japan ..... 2-269131

[51] Int. Cl.[5] ..... H01J 29/70

[52] U.S. Cl. ..... 313/440; 335/213; 335/297

[58] Field of Search ..... 313/440; 335/213, 297; 358/248, 249

[56] References Cited

U.S. PATENT DOCUMENTS 4,181,908 1/1980 Yoshikawa ..... 335/213
4,712,080 12/1987 Katau ..... 335/213
4,786,383 11/1988 Meersheak et al. ..... 335/213

FOREIGN PATENT DOCUMENTS 0154438 7/1987 Japan ..... 313/440

*Primary Examiner*—Donald J. Yusko

*Assistant Examiner*—N. D. Patel

*Attorney, Agent, or Firm*—Lowe, Price, LeBlanc & Becker

[57] ABSTRACT

A deflecting yoke which is of a divisionally winding type that electric wires are wound in a plurality of slots so as to provide a saddle-shaped deflecting coil. Included in the deflecting yoke is an insulating frame having a smaller aperture section which is therein equipped with a hooking device for hooking electric wire bundles so that portions of the electric wire bundles are curved along a cathode ray tube. The curved portions of the electric wire bundles are arranged to be closer to a top of neck portion of the cathode ray tube as the corresponding electric wire bundles are wound in the slots formed at more inner position of the deflection yoke. The hooking device comprises a plurality of guide walls along which the portions of the electric wire bundles are curvedly hooked. The plurality of guide walls are partitioned by a plurality of partitions protruded in directions perpendicular to the axis of the insulating frame so as to form a plurality of guide channels which can partition and divide the electric wire bundles to considerably prevent occurrence of shorts between the electric wires.

2 Claims, 3 Drawing Sheets

DEFLECTING YOKE FOR CATHODE RAY TUBE

BACKGROUND OF THE INVENTION

The present invention relates to a structure of a divisionally winding type deflecting yoke to be provided in a cathode ray tube of a television receiver or the like.

The divisionally winding type deflecting yoke is generally arranged such that windings are divisionally formed in a plurality of slots in order to obtain a winding distribution with a high accuracy in a saddle type horizontal deflection coil, that is, the winding distribution of each slot from a central portion up to an outside portion is determined so as to obtain a desirable magnetic field distribution. Here, the respective slots are partitioned by guide ribs formed at the inner side of an insulating frame.

FIG. 1 is a perspective view showing an insulating frame on which electric wires are wound. In FIG. 1, designated at numeral 10 is a larger aperture section facing the fluorescent surface side of the cathode ray tube and at 11 is a smaller aperture section facing the top side of the neck portion thereof. Further, numeral 12 represents electric wires wound and 13 depicts guide pins disposed at end portions of guide ribs for hooking the electric wires at turning points. At the turning points, the electric wires wound at the inside of the insulating frame and the electric wires wound at the outside thereof are together bundled.

There is a problem which arises with such an arrangement, however, in that the electric wires 12*a* wound at the inside slot and the electric wires 12*b* wound at the outside slot are together bundled at the turning point of the smaller aperture section, and further the electric wires are strongly passed against each other at the turning point because of being wound with a relatively strong tension in the winding process. This arrangement can deteriorate its insulating performance and further cause occurrence of short in the case of generation of a high electric potential difference between the electric wires wound at the inside and outside of the insulating frame.

SUMMARY OF THE INVENTION

It is therefore an object of the present invention to provide a deflecting yoke which is capable of reduce the possibility of occurrence of the short between the electric wires.

According to the present invention there is provided a deflecting yoke which is a divisionally winding type that electric wires are divisionally wound in a plurality of slots constructed between an inner side and an outer side of side deflecting yoke so as to form a saddle-shaped horizontal deflecting coil with a high-accuracy winding distribution. The deflecting yoke comprises an insulating frame having a larger aperture section which faces a fluorescent surface side of a cathode ray tube and further having a smaller aperture section which faces a neck portion side of the cathode ray tube and hooking means provided in the smaller aperture section of the insulating frame. The hooking means is arranged to hook a bundle of the electric wires in each of the plurality of slots so that lengths of portion of the electric wire bundles which extend along the circumference of the neck portion of the cathode ray tube become shorter as the corresponding slots are formed at more inner positions of the deflecting yoke and the portions of the electric wire bundles more are brought to be closer to a top of the neck portion thereof. Preferably, the insulating frame has a plurality of partitions protruded in directions perpendicular to the axis of the insulating frame so as to form a plurality of guide channels each having a guide wall whereby the portions of the corresponding electric wire bundles which extend along the circumference of the neck portion of the cathode ray tube are guided.

Furthermore, according to this invention there is provided a deflecting yoke which is a divisionally winding type that electric wires are divisionally wound in a plurality of slots so as to form a saddle-shaped horizontal deflecting coil with a high-accuracy winding distribution. The deflecting yoke comprises an insulating frame having a larger aperture section which faces a fluorescent surface side of a cathode ray tube and further having a smaller aperture section which faces a neck portion side of said cathode ray tube, each of the larger aperture section and the smaller aperture section having therein hooking means for hooking a bundle of the electric wires formed for each of the plurality of slots whereat the electric wire bundles is turned. A plurality of guide ribs are constructed at the inside of the insulating frame for partitioning the electric wire bundles in each of the plurality of slots. The hooking means provided in the smaller aperture section of the insulating frame comprises a plurality of substantial arc-shaped guide walls so that the electric wire bundles wound therearound are curved along the inner circumference of the cathode ray tube and folded by end portions of the guide walls. The lengths of the plurality of guide walls are arranged to be different from each other so that the positions of the end portions thereof are shifted from each other and the positions of the plurality of guide walls are different from each other so that the folded portions of the electric wire bundles becomes closer to a top of a neck portion of the cathode ray tube as the electric wire bundles are wound in the slots formed at more inner positions of the deflecting yoke. In addition, the lengths of the portions of the electric wire bundles wound around the plurality of guide walls are arranged to become closer to the top of the neck portion thereof in accordance with becoming shorter. Further, a plurality of arc-shaped partitions are provided between the plurality of guide walls in directions perpendicular to the axis of the insulating frame so as to form a plurality of guide channels to partition the electric wire bundles.

These arrangement can prevent the electric wires from being strongly pressed in winding, thereby preventing the occurrence of shorts between the electric wires.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

A description of this invention will be made hereinbelow with respect to only one of a pair of deflecting coils which are positioned to be in opposed relation to each other.

Figure 1:
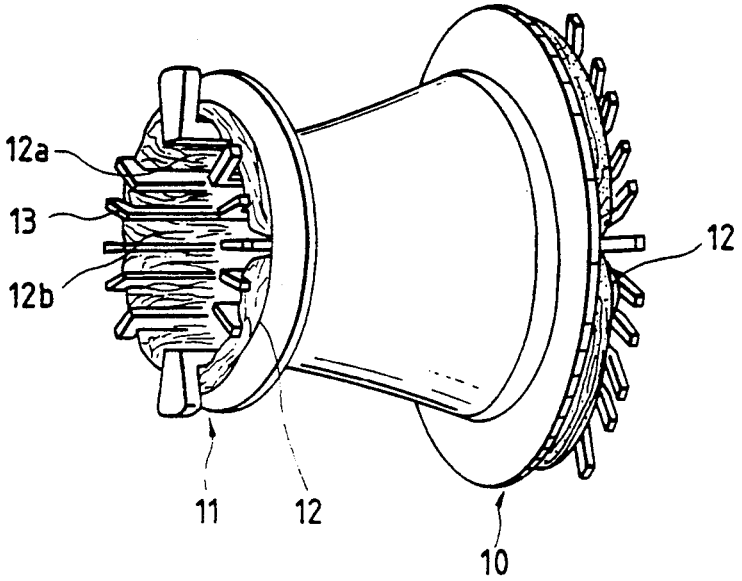
FIG. 1 PRIOR ART
FIG. 1 is a perspective view showing a prior art deflecting yoke.
Figure 2:
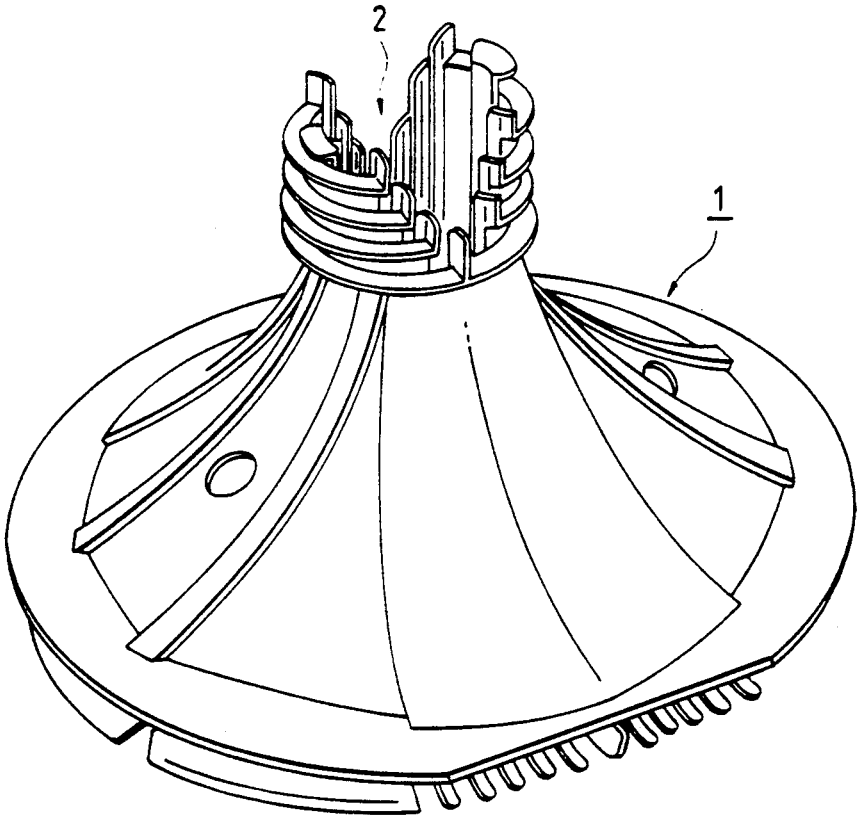
FIG. 2 is a perspective view showing an insulating frame of a deflecting yoke according to an embodiment of the present invention.
Figure 3:
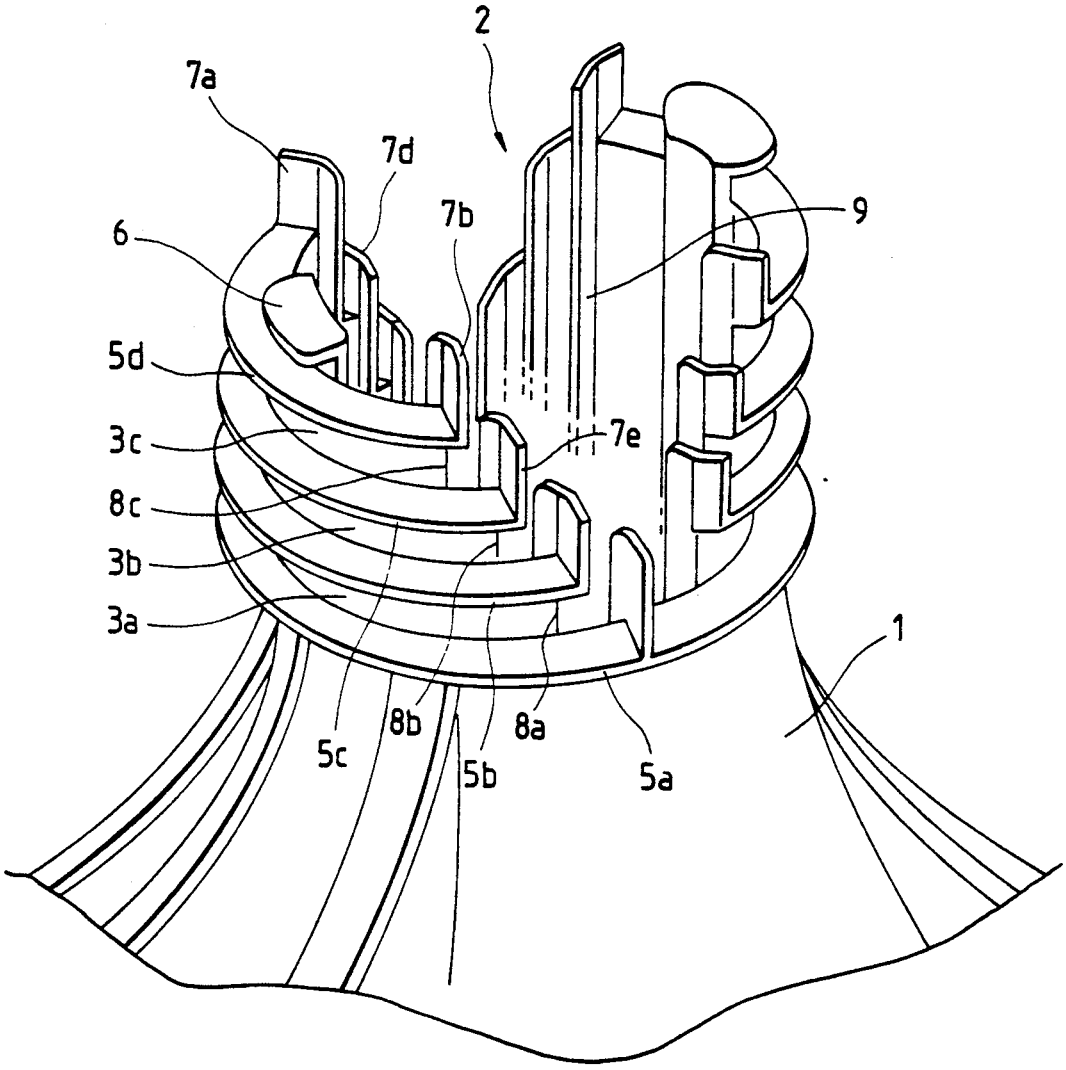
FIG. 3 is a detailed illustration of a smaller aperture section of the insulating frame shown in FIG. 2.

Referring now to FIG. 2, there is illustrated an insulating frame of a deflecting yoke according to an embodiment of the present invention. In FIG. 2, designated at numeral 1 is the insulating frame which has a through-hole for inserting a neck portion of the cathode ray tube 20 (shown in phantom). Although a general insulating frame is of a two-piece type, this insulating frame 1 is formed integrally and electric wires are wound on the integration type insulating frame 1 by means of a winding apparatus designed therefor. FIG. 3 is a perspective view showing a smaller aperture section of the insulating frame which faces the top of the neck portion of the cathode ray tube. In FIG. 3, references 3*a*, 3*b*, 3*c* and 3*d* respectively represent guide channels having guide walls for guiding the turning portions of electric wire bundles so as to run along the circumference of the cathode ray tube, and 8*a*, 8*b*, 8*c* and 8*d* respectively designate end portions of the guide channels 3*a* to 3*d*. The length of the guide channels 3*a* positioned at the longest distance from the top of the neck portion of the cathode ray tube is arranged to be longest, and the lengths of the other guide channels 3*b*, 3*c* and 3*d* are arranged to become shorter in accordance with approaching the top of the neck portion thereof. Further, the end portions 8*a* to 8*d* of the guide channels 3*a* to 3*d* are successively shifted from each other as shown in FIG. 3. In winding, the electric wires are folded due to the end portion 8*a* to 8*d* thereof.

Figure 4:
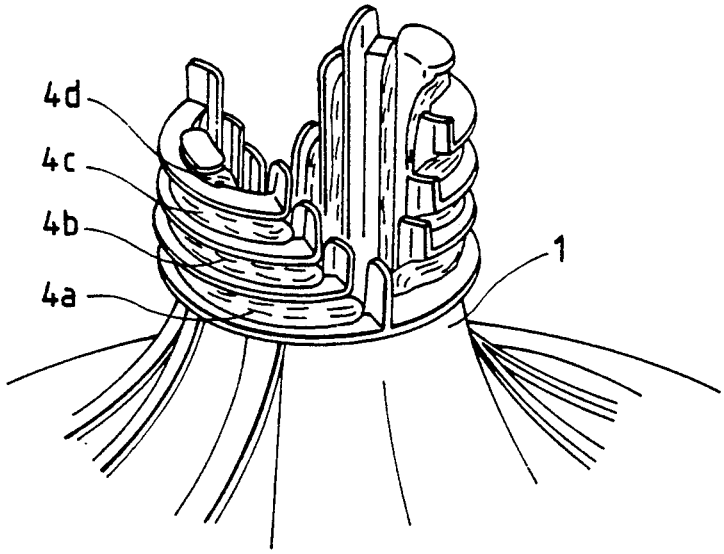
FIG. 4 is a partial perspective view showing a state of the FIG. 3 smaller aperture section where electric wires are wound.

FIG. 4 shows a state that electric wires are wound with respect to the insulating frame 1. In FIG. 4, reference 4*a*, 4*b*, 4*c* and 4*d* respectively denote electric wire bundles wound with respect to the insulating frame 1. Of these electric wire bundles 4*a* to 4*d*, the electric wire bundle 4*a* is wound at the outermost position and the electric wire bundle 4*d* is wound at the innermost position. The electric wire bundles 4*b* and 4*c* are wound at positions between the electric wire bundles 4*a* and 4*d*. The electric wire bundle 4*a* is hooked by the guide wall of the guide channel 3*a* so as to be partially curved (looped up) in conformity to the cathode ray tube. Since as described above the guide channel 3*a* has the longest length, the length of the curved portion of the electric wire bundle 4*a* (i.e., the length of a portion of the electric wire bundle 4*a* which extends along the circumference of the neck portion of the cathode ray tube) results in being longest as compared with the curved portions of the other bundles 4*b*, 4*c* and 4*d*. Further, The electric wire bundles 4*b* and 4*c* are respectively hooked by the guide walls of the guide channels 3*b* and 3*c* so as to be curved in conformity to the cathode ray tube. Thus, the lengths of the curved portions of the electric wire bundles 4*b* and 4*c* respectively correspond to the lengths of the guide channels 3*b* and 3*c* which become shorter in accordance with approaching the top of the neck portion of the cathode ray tube. That is, the length of the curved portion of the electric wire bundle is arranged to become shorter as being wound in more inner slots and the shorter curved portion of the electric wire bundle is arranged to more approach the top of the neck portion of the cathode ray tube.

Figure 5:
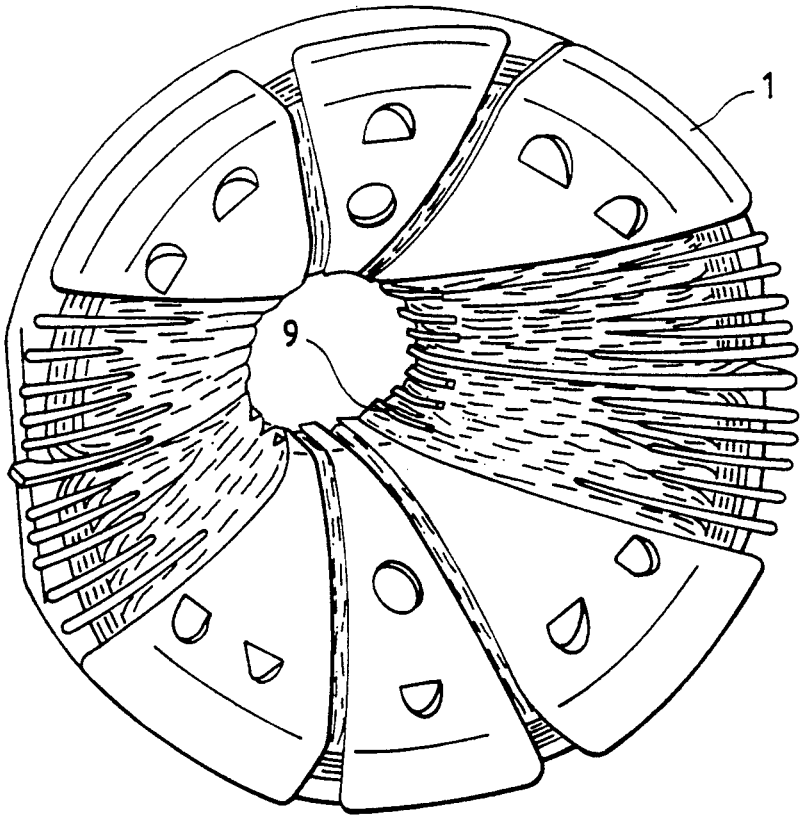
FIG. 5 is a partially broken illustration of the deflecting yoke of the invention which is viewed from the rear side of the insulating frame.

Returning back to FIG. 3, references 5*a*, 5*b*, 5*c*, 5*d* and 5*e* respectively represent arc-shaped partitions protruded in directions perpendicular to the axis of the insulating frame 1 for forming the guide channels 3*a* to 3*c* to partition the electric wire bundles 4*a* to 4*d*, thereby preventing the contact therebetween. In addition, references 7*a* and 7*b* denote projections provided at both end portions of each of the partitions 5*a* to 5*d* and used in winding the electric wires. Furthermore, as illustrated in FIG. 5, a number of guide ribs are provided at the inside of the insulating frame 1 to partition the electric wires in each slot.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A deflecting yoke which is a divisionally winding type wherein electric wires are divisionally wound in a plurality of slots constructed between an inner side and an outer side of said deflecting yoke so as to form a saddle-shaped horizontal deflecting coil with a high-accuracy winding distribution, comprising:

an insulating frame having a larger aperture section which faces a fluorescent surface side of a cathode ray tube and further having a smaller aperture section having an open end and facing a neck portion side of said cathode ray tube; and wherein said smaller aperture section of said insulating frame includes means for hooking a bundle of said electric wires in each of said plurality of slots, said means for hooking including a plurality of partitions protruding in a direction perpendicular to an axis of said insulating frame so as to form a plurality of arc-shaped guide channels, each guide channel having a guide wall, wherein each said guide channel receives a bundle of said electric wires separated by said partitions, said guide channels extending longitudinally along said axis of said insulating frame, the length of each said guide wall decreasing in a direction towards said open end of said small aperture section such that lengths of portions of said electric wire bundles that extend along a circumference of said neck portion respective said guide channel also decrease in said direction.

2. A deflecting yoke which is a divisionally winding type that electric wires are divisionally wound in a plurality of slots, said slots including inner slots disposed between outer slots, so as form a saddle-shaped horizontal deflecting coil with a high-accuracy winding distribution, comprising:

an insulating frame having a larger aperture section which faces a fluorescent surface side of a cathode ray tube and further having a smaller aperture section having an open end and facing a neck portion side of said cathode ray tube, each of said larger aperture section and said smaller aperture section having therein hooking means for hooking a bundle of said electric wire formed for each of said plurality of slots whereat an electric wire bundle is turned; and a plurality of guide ribs constructed at the inside of said insulating frame for partitioning said electric wire bundles in each of said plurality of slots, wherein said hooking means provided in said smaller aperture section of said insulating frame comprises a plurality of substantial arc-shaped guide walls arranged generally perpendicular to an axis of said insulating frame so that said electric wire bundles wound therearound are formed into folded portions by end portions of said guide walls and curved along a circumference of said cathode ray tube, and lengths of said plurality of guide walls are different from each other so that the positions of said end portions thereof are shifted from each other and positions of said plurality of guide walls are different from each other so that the folded portions of said electric wire bundles become closer to said open end as said electric wire bundles are wound in said inner slots, said lengths of the guide walls being progressively shorter as said guide walls extend toward said open end, and a plurality of arc-shaped partitions are provided between said plurality of guide walls in directions perpendicular to said axis of said insulating frame so as to form a plurality of guide channels to partition said electric wire bundles.

* * * * *